United States Patent [19]

Rees

[11] Patent Number: 4,813,219

[45] Date of Patent: Mar. 21, 1989

[54] METHOD AND APPARATUS FOR MAKING CONDUCTIVE YARN

[75] Inventor: John J. M. Rees, Toccoa, Ga.

[73] Assignee: Coats & Clark Inc., Toccoa, Ga.

[21] Appl. No.: 208,172

[22] Filed: Jun. 17, 1988

Related U.S. Application Data

[62] Division of Ser. No. 47,776, May 8, 1987, Pat. No. 4,776,160.

[51] Int. Cl.[4] ..... D07B 3/00; D02G 3/12; D02E 3/44

[52] U.S. Cl. ..... 57/3; 57/6; 57/901

[58] Field of Search ..... 57/200, 210, 212, 216, 57/229, 901, 3, 6, 9, 12; 174/126 R, 128 R, 192

[56] References Cited

U.S. PATENT DOCUMENTS

| | | | |
|---|---|---|---|
| 2,321,021 | 6/1943 | Dyer | 174/192 R |
| 2,359,090 | 9/1944 | Dyer | 57/212 X |
| 2,882,677 | 4/1959 | Davey | 57/3 |
| 3,291,897 | 12/1966 | Bromley | 174/128 R X |
| 3,413,798 | 12/1968 | Zur | 57/901 X |
| 3,422,460 | 1/1969 | Burke et al. | 57/901 X |
| 3,572,344 | 3/1971 | Bolduc | 174/128 R X |
| 3,639,807 | 2/1972 | McCune | 57/901 X |
| 3,644,866 | 2/1972 | Deardurff | 57/229 X |
| 3,882,667 | 5/1975 | Barry | 57/901 X |
| 3,977,170 | 8/1976 | Sendinger | 57/3 X |
| 4,309,867 | 1/1982 | Ichikawa | 57/3 X |
| 4,384,449 | 5/1983 | Byrnes et al. | 57/210 |
| 4,422,483 | 12/1983 | Zins | 57/901 X |

*Primary Examiner*—Donald Watkins
*Attorney, Agent, or Firm*—Burgess, Ryan & Wayne

[57] ABSTRACT

A conductive yarn includes a continuous non-conductive carrier thread having a relatively low modulus of elasticity; a continuous metal thread; and the carrier thread being wrapped around the metal thread. A process for making such conductive yarn includes the steps of pulling the continuous metal thread off a first package; pulling the continuous carrier thread off a second package; applying a relatively high tension to the carrier thread with respect to the tension on the metal thread as both threads are being pulled off their respective packages; and wrapping the tensioned carrier thread around the pulled metal thread. Apparatus for performing the method is also provided.

14 Claims, 3 Drawing Sheets

METHOD AND APPARATUS FOR MAKING CONDUCTIVE YARN

This is a division of application Ser. No. 047,776, filed May 8, 1987, now U.S. Pat. No. 4,776,160.

BACKGROUND OF THE INVENTION

This invention relates generally to yarns, and more particularly, is directed to a conductive yarn and a method and apparatus for making the same.

In many instances, it is desirable and often necessary to provide fabric which is conductive or which at least has some portions thereof that are conductive. For example, such conductive fabric can be used in transcutaneous transducer garments sold by Bio-Stimu Trend Corp. of Opa Locka, Fla. In such garments, electrodes are attached to the garments to stimulate the muscles of a patient. In the past, such electrodes have been applied directly to the skin of the patient with a wire attached from each electrode to a source of electric potential. However, when the electrodes are constructed into the garments, portions of the garment can be made of a conductive yarn so as to connect the electrodes to the source of electric potential without the numerous loose wires and the like previously used.

As a result, patient mobility is not restricted by cables, wires or tapes. There is also no separation or disconnection of the electrodes from the body parts by movement or after prolonged wear. Still further, several garments may be worn and simultaneously supplied with current. Also, because the electrodes are built into the garments, they do not require adhesives thereby eliminating certain types of allergic skin reactions, hair removal is not required, skin burns are reduced and problems with skin perspiration and oily skin are effectively eliminated.

Another use for fabric made of a conductive yarn is as a lightning strike arrester, for example, in any airborne vehicle. Still another use is in a conductive wrist band as disclosed in U.S. Patent Application Ser. No. 794,755, filed Nov. 4, 1985, now Pat. No. 4,654,748, by John J. M. Rees, entitled Conductive Wrist Band, the entire disclosure of which is incorporated herein. Still, other examples are in use on medical garments, garments for an antistatic clean room, and as an antistatic sewing thread.

Of course, in order for such yarn to be conductive, the yarn must include a conductive material. In this regard, Bekaert NVSA sells a metal thread consisting only of stainless steel under the trademarks "Bekinox VS" and "Bekinox VN". However, such threads generally have little or no stretch and break easily. Therefore, the utility of such threads is extremely limited.

Bekaert NVSA also sells a spun yarn including chopped up fibers of intertwined polyester and metal under the trademarks "Bekitex L80/1" and "Bekitex BK50/3". Because a spun yarn is used wherein the polyester and metal threads are chopped up and intertwined, there is no continuous metal along the thread length and therefore, the conductivity throughout the fiber is not continuous. Further, there is an insufficient shock absorbing quality of the polyester yarn in such arrangement because of the chopped up nature of the spun yarn. Still further, because of the spun yarn, shedding occurs, resulting in a loss of stainless steel fibers in the Bekaert material due to washing, stretching and the like. As a result, the final product is weaker and loses some of its original desirable properties. More importantly, when using such a conductive yarn in garments, for example, in an electrical clean room, contamination of semiconductors and other electrical components may occur due to shedding of the stainless steel fibers. Still further, in order to produce the Bekaert material, multiple steps are required because of the nature of the spun yarn. Most importantly, however, there is not a high conductivity and the fiber is not consistent and uniform throughout its length that there may be faults in the materials, such as slubs and the like. It is also important that such materials be launderable and, as aforesaid, this results in a loss of some stainless steel fibers with the Bekaert Bekitex material.

A high conductivity graphite material with electrically conductive filaments wrapped around the filaments is also known from U.S. Pat. No. 4,590,122, assigned to Fiberite Corp. of Winona, Minn. In this patent, a metal thread is twisted about a carbon thread.

However, another important property that is needed in conductive yarns is stretchability. With the materal of this U.S. Patent, since carbon has a high modulus of elasticity, the material has a low stretchability. For example, for a conductive yarn to be used in the applications described above, it is preferable that the percent elongation at break be at least about 3%, and preferably within the range of 10 to 15%. The average percent elongation at break for carbon is usually 1.5% or less.

Still further, carbon is a difficult material to work with since it is not very flexible. Therefore, carbon tends to shed and the fibers thereof tend to break. Also, because of the smooth surface of carbon, metal threads wrapped thereabout tend to slip on such smooth surface and group together in spaced apart bunches. Stil further, because carbon fibers tend to break when flexed, the material of U.S. Pat. No. 4,590,122 is generally not launderable.

OBJECTS AND SUMMARY OF THE INVENTION

Accordingly, it is an object of the present invention to provide a conductive yarn that is highly conductive.

It is another object of the present invention to provide a conductive yarn that is substantially non-shedding.

It is still another object of the present invention to provide a conductive yarn that is easily and readily launderable.

It is yet another object of the present invention to provide a conductive yarn that is abrasion resistant and has high shock absorbing qualities.

It is a further object of the present invention to provide a conductive yarn that can be easily and economically manufactured, with a minimum of processing time and equipment.

It is a still further object of the present invention to provide a conductive yarn that is consistent and uniform throughout its length.

It is a yet further object of the present invention to provide a conductive yarn having low twist torque or liveliness so as to resist kinking.

It is another object of the present invention to provide a conductive yarn in which the non-conductive element thereof has a low modulus of elasticity and thereby a high stretchability.

It is still another object of the present invention to provide a conductive yarn that is extremely flexible, yet stable and comfortable.

It is yet another object of the present invention to provide a conductive yarn that substantially prevents slipping of the conductive thread on the non-conductive thread, and protects the metal component from damage.

It is a further object of the present invention to provide a conductive yarn that allows subsequent processing on weaving, knitting and sewing machines.

In accordance with an aspect of the present invention, a conductive yarn includes a continuous carrier thread having a relatively low modulus of elasticity; a continuous metal thread; and the carrier and metal threads being wrapped relatively around each other.

In accordance with another aspect of the present invention, a process of making a conductive yarn includes the steps of pulling a continuous metal thread off a first package; pulling a continuous carrier thread having a relatively low modulus of elasticity off a second package; applying a relatively high tension to the carrier thread with respect to the tension on the metal thread as both threads are being pulled off their respective packages; and wrapping the tensioned carrier thread around the pulled metal thread.

In accordance with still another aspect of the present invention, apparatus for making a conductive yarn includes means for pulling a continuous metal thread off a first package and for pulling a continous carrier thread having a relatively low modulus of elasticity off a second package; means for applying a relatively high tension to the carrier thread with respect to the tension on the metal thread as both threads are being pulled off their respective packages; and means for wrapping the tensioned carrier thread around the pulled metal thread.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 6:
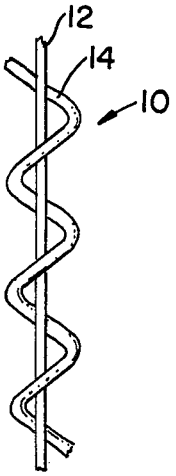
FIG. 6 is an elevational view of a conductive yarn according to the present invention, formed from the intermediate product of FIG. 5, with the metal thread wrapped about the carrier thread.

Referring to the drawings in detail, and initially to FIG. 6 thereof, a conductive yarn 10 according to the present invention includes a continuous carrier thread 12 and a continuous metal thread 14 wrapped thereabout.

Metal thread 14 is preferably made from at least one of the following materials: fine diameter metals such as nickel; copper; stainless steel; nickel chromium; nickel alloys; copper alloys; aluminum; aluminum alloys; nickel coated copper; silver coated nylon, such as that sold by Bekaert in Belgium; copper coated acrylic, such as that sold by Thunderon in Japan; nickel coated acrylic, such as that sold by Asahi Chemical in Japan; or any suitable combination of the above. Metal thread 14 can be a single filament metal wire or a multi-filament metal wire having, for example, 3, 4 or more ends of wire. Regardless of the type of metal thread used, each filament thereof is continuous and preferably has a diameter in the range of 0.0005 to 0.05 inch, with a preferred diameter of approximately 0.002 inch. Thus, for a monofilament metal thread, the diameter of the metal thread 14 is in the range of 0.0005 of 0.05 inch. For a multifilament metal thread, the number of filaments can range from between 2 and 1000 filaments.

Because metal thread 14 will not stretch, that is, it will break before stretching, some form of stretchability, that is, a shock absorbing quality must be built into conductive yarn 10. For this reason, metal thread 14 is preferably wrapped about carrier thread 12.

However, carrier thread 12 must have sufficient stretchability also, Thus, carrier thread 12 preferably has an elongation at break in the approximate range between 10% and 15%, although the percent elongation at break can be as little as 3%. This is in sharp distinction to carbon fibers which have an average percent elongation at break of 1.5% or less. In other words, carrier thread 12 according to the present invention has a relatively low modulus of elasticity, and therefore has a high stretchability.

Carrier thread 12 can be made from any suitable non-conductive material having a low modulus of elasticity. For example, carrier thread 12 can be a thermoplastic material, such as nylon, polyester, rayon acrylic, PEEK (polyetheretherketone), PPS (polyphenylene sulfide), PBI, polyolefin such as polyethylene or polypropylene, a liquid crystal polymer, or polycarbonate. Alternatively, a polyvinyl alcohol (PVA) which dissolves in water or an aramid fiber can be used. All of these materials have a relatively low modulus of elasticity and elongation in the 10 to 20% range in accordance with the present invention.

The sizes of carrier thread 12 can vary preferably within the range of 20–5000 denier, with a preferable range of 100–1500 denier.

With this arrangement, because threads 12 and 14 are continuous, there is a continuous and high conductivity of yarn 10. Further, because of the relatively low modulus of elasticity of carrier thread 12, conductive yarn 10 is abrasion resistant and has good shock absorbing qualities. Still further, because of the continuous nature of threads 12 and 14, there is no shedding thereof. Also, because of the low modulus of elasticity of carrier thread 12, and because of the continuous nature of the threads, conductive yarn 10 can be easily processed, is consistent and uniform throughout its length, and is launderable. Further, because of the carrier thread that is used, such as the thermoplastic material, for example, a polyester, the carrier thread 12 includes a number of interlaced surface loops which prevent metal thread 14 from slipping thereon.

Figure 5:
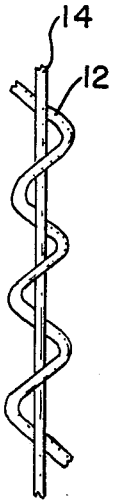
FIG. 5 is an elevational view of the conductive yarn being formed according to the present invention with the carrier thread wrapped about a metal thread.

In order to form conductive yarn 10, carrier thread 12 is initially wrapped about metal thread 14, as shown in FIG. 5, with the elongation or tension force applied to carrier thread 12 during such wrapping operation being less than the elongation or tension force on metal thread 14. When the tension forces are relieved, the end result is that of Fig. 6, that is, where metal thread 14 is wrapped about carrier thread 12 to form conductive yarn 10.

Referring now to FIGS. 1–4, apparatus 16 for forming conductive yarn 10 will now be described. As shown, a spindle housing 18 is rotated by a motor drive (not shown), for example, at the rate of 3,000–10,000 rpm. Specifically, spindle housing 18 includes a spindle whorl 20 rotatably driven by the motor drive and having a circular bottom spindle plate 22 secured thereon for rotation therewith. Bottom spindle plate 22 is circular and has a plurality of circumferentially spaced apertures 24 therein in which are positioned bearing assemblies 26. Bottom spindle plate 22 further includes a frusto-conical aperture 28 at the center thereof, the reason for which will be apparent from the discussion which follows.

Figure 1:
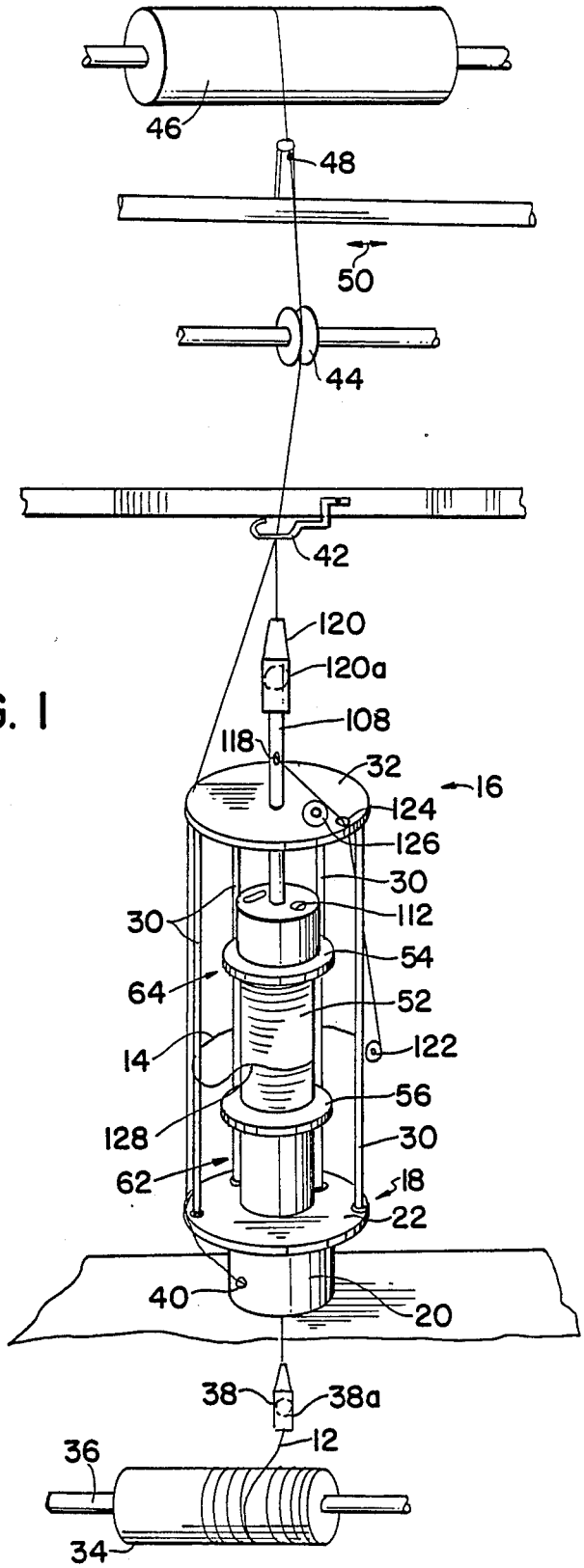
FIG. 1 is a perspective view of apparatus for making a conductive thread according to the present invention.
Figure 2:
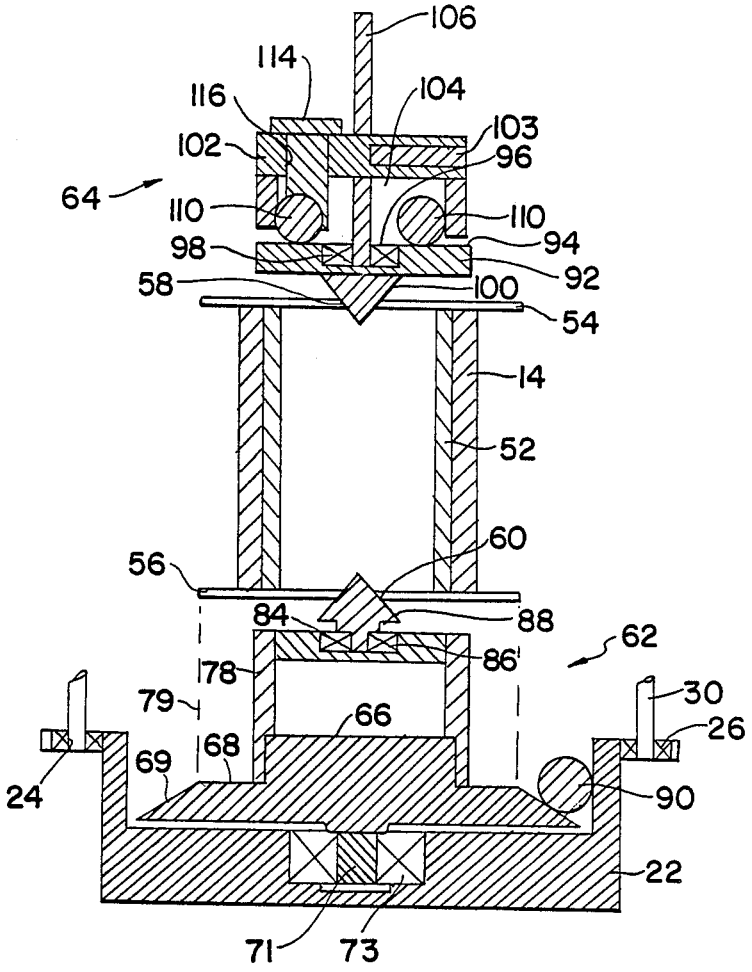
FIG. 2 is a cross-sectional view of a portion of the apparatus of FIG. 1.
Figure 3:
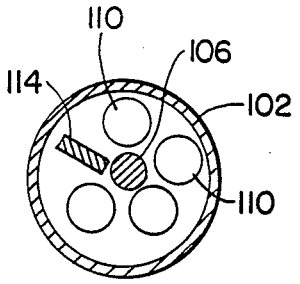
FIG. 3 is a cross-sectional view of a portion of the apparatus of FIG. 1.
Figure 4:
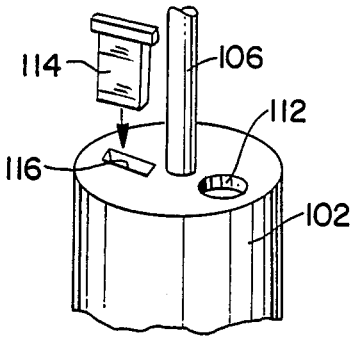
FIG. 4 is a perspective view of a portion of the apparatus of FIG. 1, in partially exploded view.

As shown best in FIGS. 1 and 2, a plurality of traverse rods 30 have their lower ends rotatably secured within bearing assemblies 26 so as to extend vertically upward from bottom spindle plate 22 and so as to be rotatably mounted therein.

A circular top spindle plate 32 is provided in substantially parallel spaced relation from bottom spindle plate 22, top spindle plate 32 also including a plurality of circumferentially spaced apertures (not shown) having bearing assemblies (not shown) therein for rotatably fitting the upper ends of traverse rods 30 therein. In other words, traverse rods maintain bottom spindle plate 22 and top spindle plate 32 in substantially parallel, spaced relation, while being rotatably mounted with respect to bottom spindle plate 22 and top spindle plate 32 by reason of the bearing assemblies.

Carrier thread 12 is mounted on a spool 34 which is freely rotatable on a shaft 36. Carrier thread 12 extends from spool 34, through a spring tension device 38, into the interior of spindle whorl 20 and out through a side hole 40 therein. Carrier thread 12 then passes around the outer peripheries of bottom spindle plate 22 and top spindle plate 32, whereupon it enters a balloon control guide 42, passes on to a pretake-up roller 44 and is guided onto a doff package 46 by a traverse guide 48. Doff package 46 is rotated by a motor (not shown) so as to pull carrier thread 12 from spool 34 and conductive thread 14 from spool 52, and traverse guide 48 reciprocates in the direction of arrow 50 so as to evenly distribute carrier thread 12 combined with conductive thread 14 into yarn 10 on doff package 46.

As previously discussed, in accordance with the present invention, when forming the conductive yarn 10 according to the present invention, a relatively high tension is applied to carrier thread 12 with respect to the tension on conductive thread 14. Accordingly, spring tension device 38, which is a conventional device, has two ceramic discs (not shown) therein that pinch carrier thread 12 therebetween, one disc being spring loaded to vary the pinching force on carrier thread 12 and to thereby vary the tension on carrier thread 12. The spring loading force is variable by a control dial 38a on the outside of spring tension device 38.

In accordance with the present invention, metal thread 14 is wound on a spool 52 having upper and lower circular flanges 54 and 56, respectively, although metal thread 14 could be wound on a cheese package (not shown). As is conventional, spool 52 is hollow and flanges 54 and 56 have central frusto-conical apertures 58 and 60, respectively, as shown in FIG. 2. In order to support spool 52 in a freely rotatable manner with respect to spindle housing 18, a ball bearing tension device 62 for cheese packages is provided for supporting spool 52 on bottom spindle plate 22 in a freely rotatable manner and a ball bearing tension device 64 for spools is provided for freely rotatably guiding spool 52 with respect to top spindle plate 32.

Specifically, as shown in FIG. 2, ball bearing tension device 62 includes a cylindrical bearing cap 66 formed with a lower outer cylindrical ledge 68 having a downwardly inclined outer surface 69 includes a tension cap 71 at its lower end which rotates within a bearing assembly 73 in bottom spindle plate 22.

A cylindrical adaptor spacer 78 fits on ledge 68 of bearing cap 66 and has an annular inner shoulder 82 formed at its lower end that sits on the upper surface of bearing cap 66. Adaptor 78 has a central aperture 84 at its upper, closed end in which is fit a bearing assembly 86 that holds a substantially conical bearing support 88. Bearing supports 88 fits within frusto-conical central aperture 60 of lower circular flange 56, whereby ball bearing tension device 62 is freely rotatable with respect to bottom spindle plate 22 and spool 52.

In the embodiment shown in FIGS. 1 and 2, spool 52 fits on top of ball bearing idler 88. On the other hand, when a cheese package is used, the cheese package (not shown) fits about ball bearing tension device 62 and sits on top of lower outer cylindrical ledge 68, as shown by dashed lines 79. Therefore, as metal thread 14 is pulled off of spool 52, and spool 52 rotates slightly, ball bearing tension device 62 would also rotate with spool 52. During such rotation, balls 90, which sit on inclined outer surface 69, rotate along the outer periphery at the inside of tension device 62 and provide a drag on such rotation. The amount of drag depends upon the number of balls 90 within tension device 62, and accordingly, tension device 62 can be used for smoothly applying tension to metal thread 14, which tension can be finely tuned by adding or taking away from the number of balls 90 within tension device 62.

Tension device 64 is constructed in a similar manner to tension device 62 and includes a cylindrical bearing cap 92 having a central aperture 96 in the upper end thereof in which is fit a bearing assembly 98. An inverted, substantially conical bearing support 100 is secured to the lower surface of bearing cap 92, and fits in central aperture 58 of upper circular flange 54 of spool 52, whereby bearing cap 92 is rotatably supported on spool 52. A cylindrical assembly top 102, open at its lower end, is fit over bearing cap 92 and spaced slightly therefrom, so as to define an enclosure 104. Specifically, a shaft 106 has its lower end centrally fixed within the upper, closed end of assembly top 102 by an allen screw 103 and extends further so as to be rotatably supported on bearing cap 92 by bearing assembly 98. The opposite end of shaft 106 is freely rotatable through top spindle plate 32 and into a shaft guide bar 108 that extends centrally from top spindle plate 32. In this manner, spool 52 is freely rotatable with respect to top spindle plate 32.

A plurality of balls 110 are provided within enclosure 104 of tension device 64, so that during rotation thereof, balls 110 are forced outwardly toward the outer circumference of enclosure 104 to provide a drag on rotation thereof and to thereby provide a tensioning force on spool 52. As with tensioning device 62, the greater the number of balls 110, the greater the drag that is produced. In order to increase the drag, a stop 114 can be inserted within a slot 116 in assembly top 102 to prevent rotation of balls 110 and thereby provide a greater drag.

As aforementioned, carrier thread 12 is pulled off at a higher tension than the tension applied to metal thread 14. For example, carrier thread 12 may have a tension of 3–200 grams applied to it as it comes off of spool 34.

Referring back to FIG. 1, and as will now be discussed, metal thread 14 is pulled off of spool 52 and enters an aperture 118 in shaft guide bar 108, travelling therefrom upwardly through shaft guide bar 108. At the upper end of shaft guide bar 108, a string tension device 120 is provided having a control dial 120*a* thereon. Spring tension device 120 is constructed substantially identically to spring tension device 38. From spring tension device 120, metal thread 14 travels vertically upward through balloon control guide 42. Since metal thread 14 travels upwardly in a straight manner without twisting and since carrier thread 12 is continuously rotating with spindle housing 18, carrier thread 12 is wrapped about metal thread 14 when both pass through balloon control guide 42 to arrive at the arrangement shown in FIG. 5. The resultant yarn is then carried by pretake-up roller 44, through traverse guide 48 and wound on doff package 46. It is doff package 46 that pulls both carrier thread 12 and metal thread 14.

The above arrangement is simlar to a conventional cabling arrangement, that is, where two non-metallic threads are used. In such cabling operation, however, the center yarn is brought straight up directly off of the spool and, as a result, a twist is imparted to the center yarn. Such twist cannot be imparted to a metal thread, however, since the metal thread will break.

Therefore, in accordance with the present invention, metal thread 14 is rolled radially off of spool 52 and is wrapped about the outer circumference of traverse rods 30. The last traverse rod 30 has a micro-bearing 122 mounted thereon and metal thread 14 extends through micro-bearing 122 and is turned vertically upward, whereupon it passes through an aperture 124 at the periphery of top spindle plate 32. After passing through aperture 124, metal thread 14 passes over another micro-bearing 126 mounted on top spindle plate 32, and then into aperture 118, and another micro bearing mounted inside shaft guide bar 108 just before tension device 120a. As a result of this rolling off of metal thread 14 about traverse rods 30, by the time metal thread 14 reaches micro-bearing 122, there is an increase in the distance from the exit point 128 off of spool 52 to the pivot point at micro-bearing 122, thereby preventing sharp angles which would disrupt the winding layers on spool 52 and would rub as it is rolled of, thereby breaking metal thread 14.

Preferably, there is a relationship maintained between the height of spool 52 and the distance from the exit point 128 off of spool 52 to micro-bearing 122 where it is turned upwardly. Ideally, the distance from the exit point 128 to micro-bearing 122 should be approximately 1.5 times the height of spool 52. As a result of this arrangement, there is a decrease in the amount of friction applied to metal thread 14 as it comes off of spool 52, thereby increasing the life of the contact points with metal thread 14 since the metal thread is not dragged across the contact points. Further, because there is no twist in metal thread 14, fine delicate metal threads can be run at a higher speed.

With this arrangement, the conductive yarn 10 of FIG. 6 can be produced. Specifically, such conductive yarn 10 is highly conductive, substantially non-shedding, is easily and readily launderable, is abrasion resistant and has high shock absorbing qualities, is consistent and uniform throughout its length, has a low twist torque or liveliness so as to resist kinking, has a high stretchability and is extremely flexible, and is easily and economically manufactured.

Although the above apparatus describes the primary way for forming the final conductive yarn construction, other processes may be employed for forming the carrier portion of the construction, such as air interlacing (both core and effect and parallel), spun, stretch broken, extruded parallel filaments, or conventional twisted methods. The carrier yarn can be wrapped about the metal component in either a clockwise or counterclockwise direction (S or Z direction). The number of wraps per inch can be varied from 0.5 to 20; preferably 5–11. For optimum shock absorbing characteristics, there should be approximately 11 wraps per inch.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined in the appended claims.

What is claimed is:

1. A process of making a conductive yarn, comprising the steps of:

pulling a continuous metal thread off a first package;

pulling a continuous carrier thread having a relatively low modulus of elasticity off a second package;

applying a relatively high tension to said carrier thread with respect to the tension on said metal thread as both threads are being pulled off their respective packages; and wrapping the tensioned carrier thread around said pulled metal thread.

2. A process according to claim 1; further including the step of lowering the tension on said carrier thread after the carrier thread has been wrapped around said metal thread, whereby said metal thread becomes wrapped around said carrier thread.

3. A process according to claim 1; wherein said step of pulling said metal thread includes the step of rolling said metal thread substantially radially off the first package.

4. A process according to claim 3; wherein said step of pulling said metal thread further includes the steps of:

pulling said rolled off metal thread about a plurality of circumferentially spaced traverse rods; and pulling said metal thread from a last one of said traverse rods through bearing means to change the direction thereof by substantially a right angle.

5. Apparatus for making a conductive yarn, said apparatus comprising:

means for pulling a continuous metal thread off a first package and for pulling a continuous carrier thread having a relatively low modulus of elasticity off a second package;

means for applying a relatively high tension to said carrier thread with respect to the tension on said metal thread as both threads are being pulled off their respective packages; and means for wrapping the tensioned carrier thread around said pulled metal thread.

6. Apparatus according to claim 5; wherein said means for wrapping includes spindle housing means for rotatably guiding said carrier thread in a circular manner about said metal thread.

7. Apparatus according to claim 6; wherein said spindle housing means includes rotatable spindle whorl means for rotating said carrier thread and spindle plate means for guiding said rotated carrier thread about said metal thread.

8. Apparatus according to claim 7; wherein said spindle plate means includes a circular bottom spindle plate rotatable with said spindle whorl means and a circular top spindle plate spaced from said bottom spindle plate in a substantially parallel relation, and tranverse rod means for securing said top and bottom spindle plates in said substantially parallel, spaced relation.

9. Apparatus according to claim 8; wherein said traverse rod means includes a plurality of traverse rods connected at opposite ends to said top and bottom spindle plates and rotatable with respect to said top and bottom spindle plates.

10. Apparatus according to claim 9; further including bearing means connected to at least one of said traverse rods, whereby said metal thread is rolled off said second package, around said traverse rods, and around said bearing means to change the direction thereof.

11. Apparatus according to claim 9; further including means for mounting said second package carrying said metal thread between said bottom and top spindle plates and between said traverse rods in a freely rotatable manner.

12. Apparatus according to claim 11; wherein said means for mounting includes first tension means for mounting said second package on said bottom spindle plate in a freely rotatable manner and top tension means for guiding said second package with respect to said top spindle plate in a freely rotatable manner.

13. Apparatus according to claim 5; further including means for varying the tension on said carrier thread.

14. Apparatus according to claim 5; further including means for varying the tension on said metal thread.

* * * * *